US007711290B2

(12) United States Patent
Lee et al.

(10) Patent No.: US 7,711,290 B2
(45) Date of Patent: May 4, 2010

(54) DEVELOPER AGITATOR INCREASING ELECTRIFICATION RATE OF DEVELOPER, AND DEVELOPING APPARATUS AND IMAGE FORMING DEVICE HAVING THE SAME

(75) Inventors: Sang-don Lee, Gwacheon-si (KR); Jin-geun Kwak, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 161 days.

(21) Appl. No.: 11/708,005

(22) Filed: Feb. 20, 2007

(65) Prior Publication Data

US 2008/0050152 A1 Feb. 28, 2008

(30) Foreign Application Priority Data

Aug. 25, 2006 (KR) ..... 10-2006-0081259

(51) Int. Cl.
*G03G 15/08* (2006.01)

(52) U.S. Cl. ..... 399/254; 399/256

(58) Field of Classification Search ..... 399/254, 399/256

See application file for complete search history.

(56) References Cited

U.S. PATENT DOCUMENTS 4,146,323 A * 3/1979 Forward et al. ..... 399/256
4,878,088 A * 10/1989 Nakanishi et al. ..... 399/119
5,519,470 A * 5/1996 Corrigan, Jr. ..... 399/256
5,758,238 A * 5/1998 Mordenga et al. ..... 399/256
6,281,961 B1 * 8/2001 Sako et al. ..... 355/27
6,985,685 B2 * 1/2006 Shigeta et al. ..... 399/254
7,391,998 B2 * 6/2008 Aoki et al. ..... 399/254
2005/0008400 A1 1/2005 Tazawa et al.
2005/0284197 A1 * 12/2005 Pinkowski et al. ..... 68/133
2006/0159492 A1 7/2006 Yokoyama
2007/0071503 A1 * 3/2007 Sato ..... 399/258
2007/0081832 A1 * 4/2007 Yoshida et al. ..... 399/254

FOREIGN PATENT DOCUMENTS

JP 4-274468 9/1992
JP 2005-148288 6/2005
SU 594314 * 2/1978

OTHER PUBLICATIONS

Office Action issued in corresponding European Patent Application No. 07105095.9 dated Jan. 24, 2008.

* cited by examiner

*Primary Examiner*—Quana M Grainger
(74) *Attorney, Agent, or Firm*—Staas & Halsey LLP

(57) ABSTRACT

A developer agitator of an image forming device capable of improving the electrification rate of a developer is disclosed. The developer agitator includes a rotatable shaft and an agitating wing disposed on the circumferential surface of the shaft. The agitating wing has an uneven part formed to increase the contact area with a developer. The developer agitator can obtain an electrification rate of the developer required for high speed printing, thereby allowing the image forming device to be operated at a high speed.

19 Claims, 5 Drawing Sheets

DEVELOPER AGITATOR INCREASING ELECTRIFICATION RATE OF DEVELOPER, AND DEVELOPING APPARATUS AND IMAGE FORMING DEVICE HAVING THE SAME

CROSS-REFERENCE TO RELATED APPLICATIONS

This application claims the benefit of Korean Application No. 2006-81259, filed Aug. 25, 2006, in the Korean Intellectual Property Office, the disclosure of which is incorporated herein by reference.

BACKGROUND OF THE INVENTION

1. Field of the Invention

Aspects of the present invention relate to an agitator, and more particularly, to an agitator that electrifies a developer with friction, a developing apparatus having the agitator, and an image forming device having the agitator.

2. Description of the Related Art

An image forming device, such as a printer, that uses an electrophotography process, is an apparatus, which forms an electrostatic latent image on a photoconductor using a light exposing unit, develops the electrostatic latent image with a developer by using a developing apparatus to form a developer image, and then transfers and fixes the developer image onto a printing medium.

The developer, which is used for developing the electrostatic latent image in the developing apparatus, is either a one-component system developer or a two-component system developer. In case of the one component system developer, toner particles are electrified by friction with themselves or friction with a charging member. The electrified toner particles are moved onto a developing roller and then attached to an electrostatic latent image region of the photoconductor to form a developer image.

A two-component system developer is a developer in which magnetic carrier particles are mixed with non-magnetic toner particles made of synthetic resins. The toner particles are electrified by friction with the carrier particles and with themselves. The electrified toner particles are moved onto the developing roller along with the carrier particles and then attached to an electrostatic latent image region of the photoconductor to form a developer image.

In general, a developing apparatus of an image forming device is provided with an agitator to electrify the toner particles of a developer by friction. A conventional agitator is shown in FIGS. 1A and 1B. As shown in FIG. 1A, the agitator 1 has a structure in which an agitating wing 3 is in the form of a helix on a rotary shaft 2. The agitator 1 rotates in a developer-containing space of a developer casing (not shown). As the agitating wing 3 rotates, toner particles and, if it is a two-component system, carrier particles are mixed with one another, and the toner particles are electrified by friction.

The longer the contact time of the toner particles, and in a two-component system, to the carrier particles and the greater the number of the toner particles contacted, the smoother the electrification of the toner particles that is achieved. To carry out a printing operation at a high speed, it is required that the toner particles be charged in a short time. However, for a conventional agitator to lengthen the contact time of the toner particles to the carrier particles or to increase the number of the toner particles contacted, the agitating wing 3 should be quickly rotated or the diameter thereof enlarged. To quickly rotate the agitating wing 3, a change to the design of the agitator driving system would be required, and to enlarge the diameter of the agitating wing 3 would require a layout change of the developing apparatus. Neither alternative is particularly desirable.

SUMMARY OF THE INVENTION

Several aspects and embodiments of the present invention provide an agitator with an increased contact area of an agitating wing to thereby increase the electrification rate of a developer, without the requirement to quickly rotate the agitating wing or to increase the diameter of the agitating wing.

Other aspects and embodiments of the present invention provide a developing apparatus and an image forming device having one or more agitators with the characteristics described above.

Additional aspects and/or advantages of the invention will be set forth in part in the description which follows and, in part, will be obvious from the description, or may be learned by practice of the invention.

In accordance with one aspect of an embodiment of the present invention, there is provided an agitator including a rotatable shaft, an agitating wing disposed on the circumferential surface of the shaft, and an uneven part formed on the surface of the agitating wing to increase a contact area with a substance to be agitated.

According to an aspect of the present invention, the uneven part may have a waved structure, a stepped structure, or a structure with both waved and stepped features. The uneven part may be constant along the agitator wing, or the waved and/or stepped features of the uneven part may vary along the length of the shaft. Also, the uneven part may be oriented in the longitudinal direction or the transverse direction of the agitating wing.

Preferably, but not necessarily, the agitating wing is disposed in the form of a helix along the shaft.

According to an aspect of the present invention, the substance to be agitated comprises a developer.

In accordance with another embodiment of the present invention, there is provided a developing apparatus including: a developing casing having a developer-containing space, a developing roller to rotate in the developing casing, a developer supplying roller to rotate in the developing casing to face the developing roller, so that the developer of the developer-containing space is supplied to the developing roller, and an agitator to electrify a developer contained in the developer-containing space by friction, as described above.

According to still another aspect of an embodiment of the present invention, there is provided an image forming device including: a photoconductor on which an electrostatic latent image is formed, a developing apparatus to develop the electrostatic latent image of the photoconductor with a developer, a transferring apparatus to transfer the developer image formed on the photoconductor onto an printing medium, and a fusing apparatus to fix the developer image transferred onto an printing medium. The developing apparatus, as described above, includes an agitator constructed as described above in the developer-containing space to agitate the developer contained in the developer-containing space, thus electrifying the developer by friction.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1A:
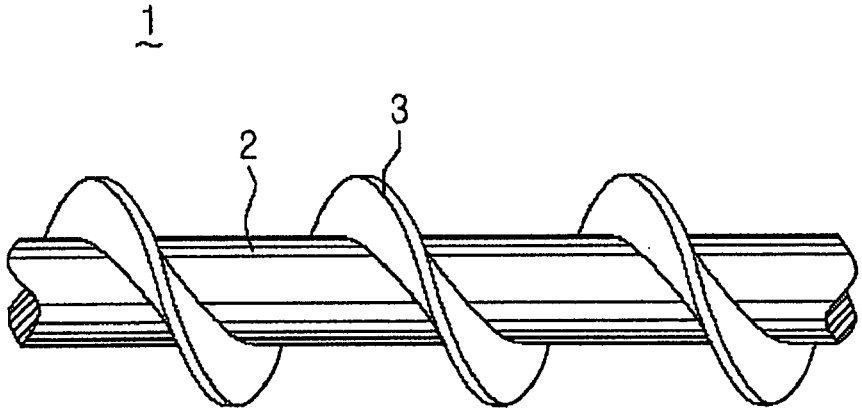
FIG. 1A (PRIOR ART)
FIGS. 1A and 1B are a perspective view and a partially magnified cross-sectional view of a section of a conventional developer.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 2A:
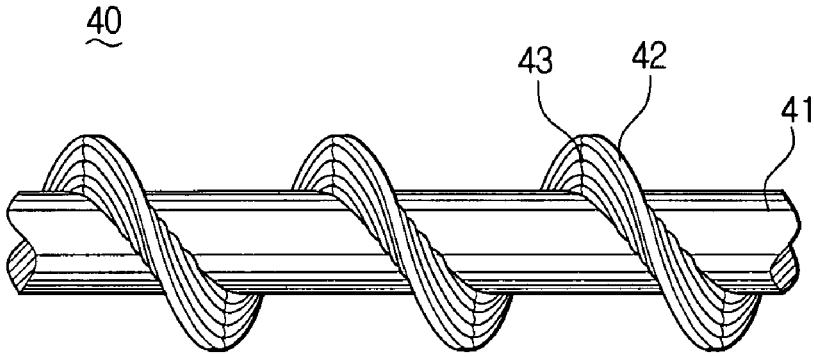
FIGS. 2A and 2B are a perspective view and a partially magnified cross-sectional view of a section of a developer agitator according to an embodiment of the present invention.
Figure 2B:
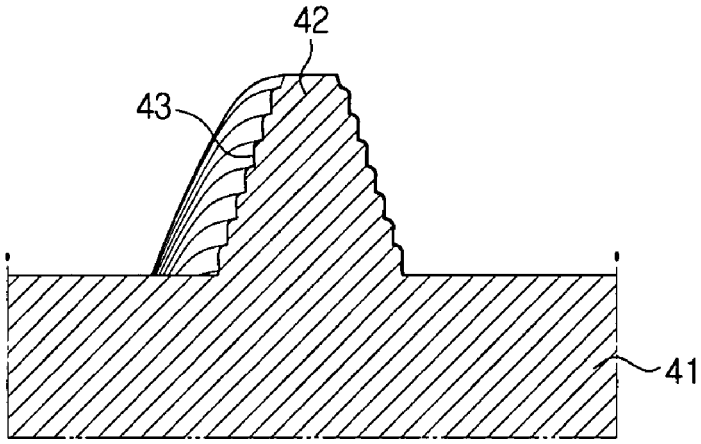

An embodiment of the present invention is illustrated in FIGS. 2A and 2B: a developer agitator 40 includes a rotatable shaft 41, an agitating wing 42 disposed in the form of a helix on the circumferential surface of the shaft 41, and an uneven part 43 formed on a surface of the agitating wing 42.

Figure 4:
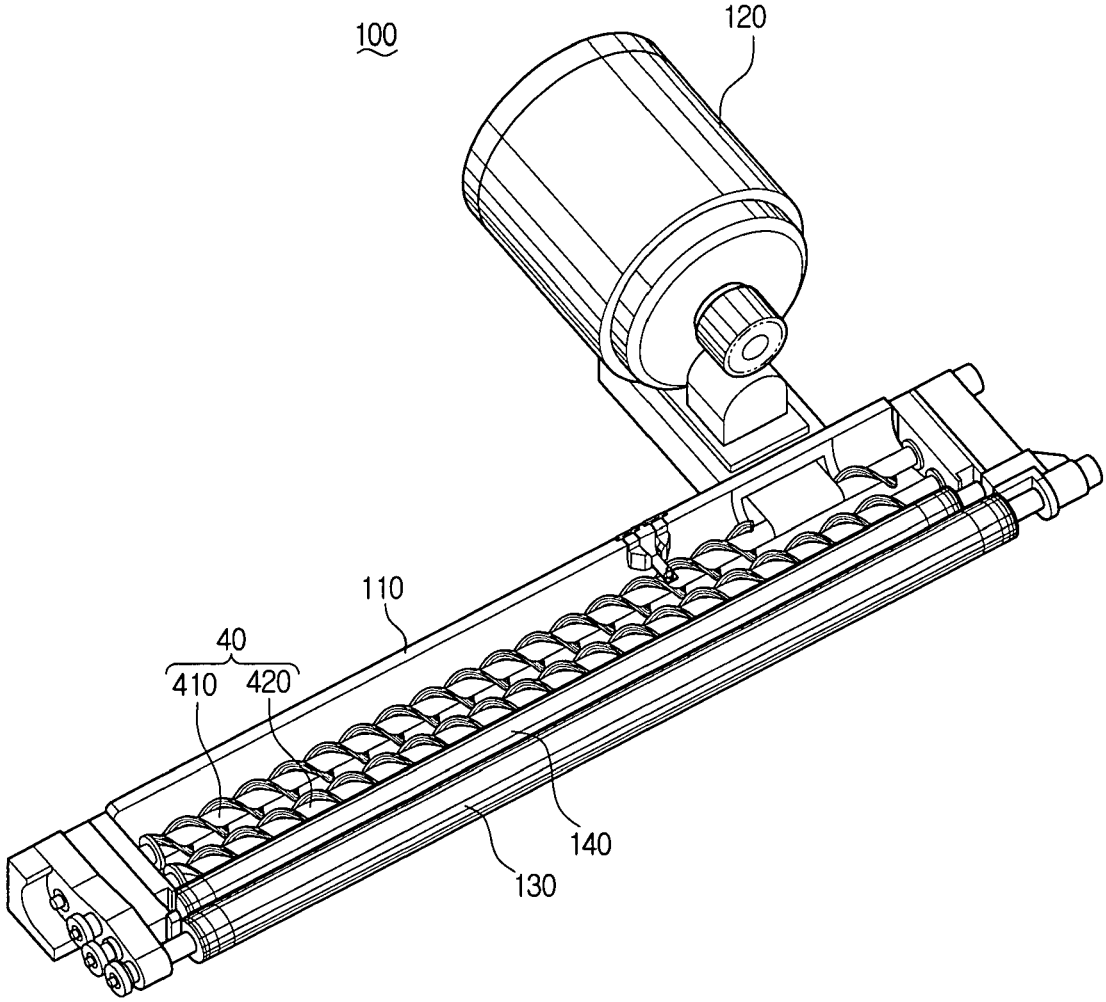
FIG. 4 is a perspective view showing a developing apparatus to which the developer agitator according to an embodiment of the present invention has been applied.

The agitator 40 constructed as described above can be used for electrifying a developer by friction in, for example, a developing apparatus 100 as illustrated in FIG. 4. In this case, the uneven part 43 formed on the surface of the agitating wing 42 increases the contact area for the developer, and thus improves the electrification rate of the developer.

That is, the conventional agitating wing 3 (see FIGS. 1A and 1B) has a smooth surface, but the agitating wing 42 of the developer agitator 40 according to the embodiment of the present invention has the uneven part 43 formed on the surface thereof, thereby allowing a surface area of the agitating wing 42 to be enlarged compared with the conventional agitating wing 3. Accordingly, the contact area of the agitating wing 42 and the developer is increased, and thus without the requirement to quickly rotate the agitating wing 42 or increase the diameter thereof, the contact time between toner particles and, in a two component system developer, carrier particles of the developer, is lengthened and the number of particles contacted thereby is increased, increasing the electrification rate of the developer.

Figure 2C:
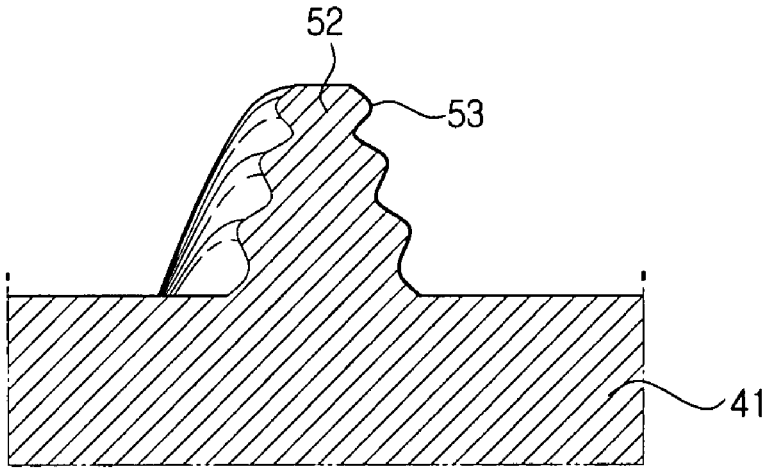
FIGS. 2C and 2D are partially magnified cross-sectional views of a developer agitator according to another embodiment of the present invention.
Figure 2D:
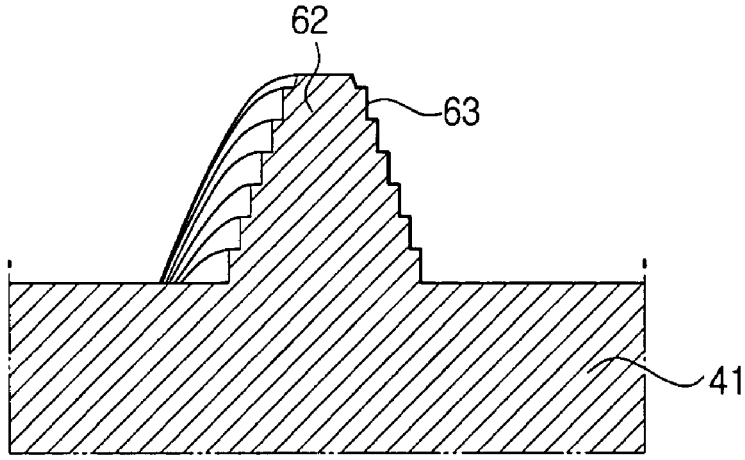

The uneven part 43 as described above can have a waved structure or a stepped structure, as illustrated by 53 and 63 in FIGS. 2C and 2D, respectively. Besides the waved structure or the stepped structure, the uneven part 43 can be configured in any combination of both waved and stepped structures that is capable of increasing the surface area thereof, an embodiment being the uneven part 43 shown in FIG. 2B. In one aspect of the present invention, the uneven part 43 has the same structure and cross-section along the entire length of the agitator 40. In another aspect of the present invention, the uneven part 43 can vary along the length of the agitator 40.

Figure 3:
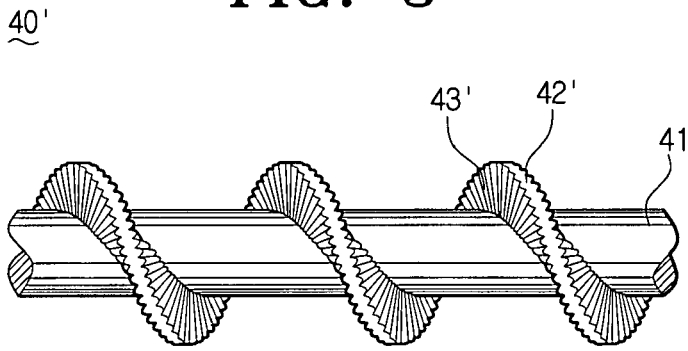
FIG. 3 is a perspective view exemplifying a section of a developer agitator according to another embodiment of the present invention.

FIG. 3 is a perspective view exemplifying a section of a developer agitator 40' according to another embodiment of the present invention. As illustrated in the drawing, the developer agitator 40' has the same basic structure as that of the developer agitator 40 of the embodiment as described above and shown in FIG. 2A, which includes a rotatable shaft 41, an agitating wing 42 disposed in the formed of a helix on a circumferential surface of the shaft 41, and an uneven part 43 formed on a surface of the agitating wing 42. However, in the embodiment of the present invention shown in FIG. 3, the orientation of the uneven part 43' is different from that of the uneven part 43 shown in FIG. 2A. That is, in the embodiment shown in FIG. 3, the uneven part 43' is oriented in the longitudinal direction of the agitating wing 42', whereas in the previous embodiment shown in FIG. 2A, the uneven part 43 is oriented in the transverse direction of the agitating wing 42.

Thus, in the embodiment of the present invention shown in FIG. 3, the surface area of the agitating wing 42' is also enlarged, so that the developer agitator 40' can obtain the same results as that of the agitator 40 in the previous embodiment shown in FIG. 2A. The formed orientation of the uneven part 43 is not limited to the examples illustrated in the drawings. For instance, the uneven part 43 can be formed in any other structure, for example, a slightly slanted structure that is capable increasing the surface area of the agitating wing 42.

FIG. 4 is a perspective view schematically exemplifying a developing apparatus 100 to which the developer agitator 40, according to the embodiment of the present invention as described above and shown in FIG. 2A, is applied. As shown in FIG. 4, the developing apparatus 100 includes a developing casing 110 having a developer-containing space formed in a predetermined shape. The developing casing 110 is provided with a developer inlet and a developer outlet. A developer cartridge 120 is connected to the developer inlet, and a developing roller 130 and a developer supplying roller 140 are rotatably disposed at the developer outlet.

Figure 1B:
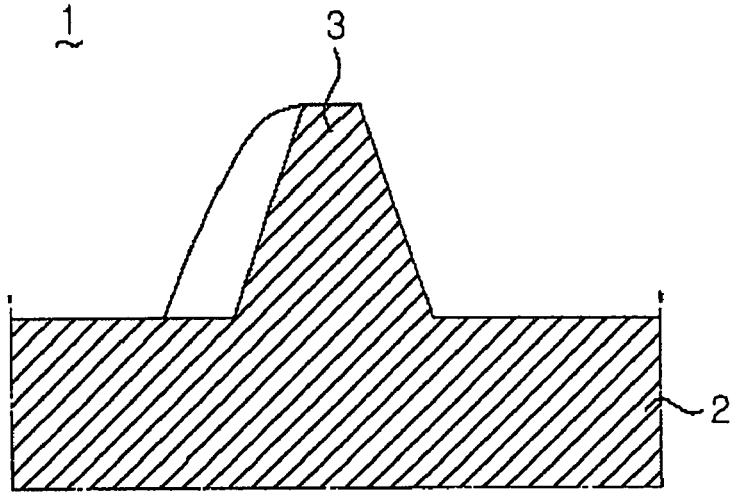
FIG. 1B (PRIOR ART)

The developer agitator 40 includes a first developer agitator 410 and a second developer agitator 420, which are rotatably disposed in the developer-containing space of the developing casing 110. A developer contained in the developer-containing space is agitated by the first and second developer agitators 410 and 420, so that the developer is electrified by friction. Because the agitating wings 42 of the developer agitators 410 and 420 have the contact areas for the developer enlarged by the uneven parts 43 formed on the surfaces thereof, the electrification rate of the developer is higher than if an agitator 1 with a smooth agitating wing 3 as shown in FIG. 1A was used.

Figure 5:
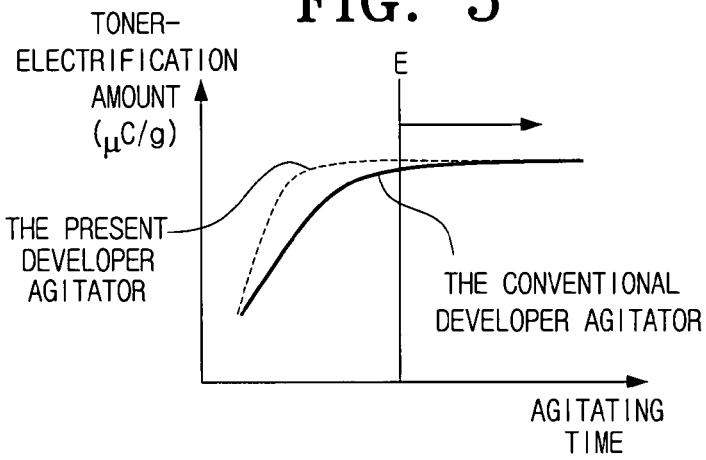
FIG. 5 is a graph showing developer electrification by a developer agitator in an embodiment of the present invention and by the conventional developer agitator shown in FIGS. 1A and 1B.

FIG. 5 is a graph exemplifying the toner-electrification amount as compared to agitating time using the developer agitator according to an embodiment of the present invention. Referring to FIG. 5, by using the developer agitator according to an embodiment of the present invention, the toner-electrification amount was saturated in a shorter time compared to using a conventional developer agitator. In an image forming device, to form an acceptable developer image the toner-electrification amount should be at least 70% of a saturated state. In FIG. 5, a reference E indicates a suitable development image point. In the developer agitator of the embodiment of the present invention, the toner-electrification amount has reached the required value before the suitable development image point E, so that the developer agitator of the embodiment of the present invention can be used in high speed printing with a shorter development image point E.

Figure 6:
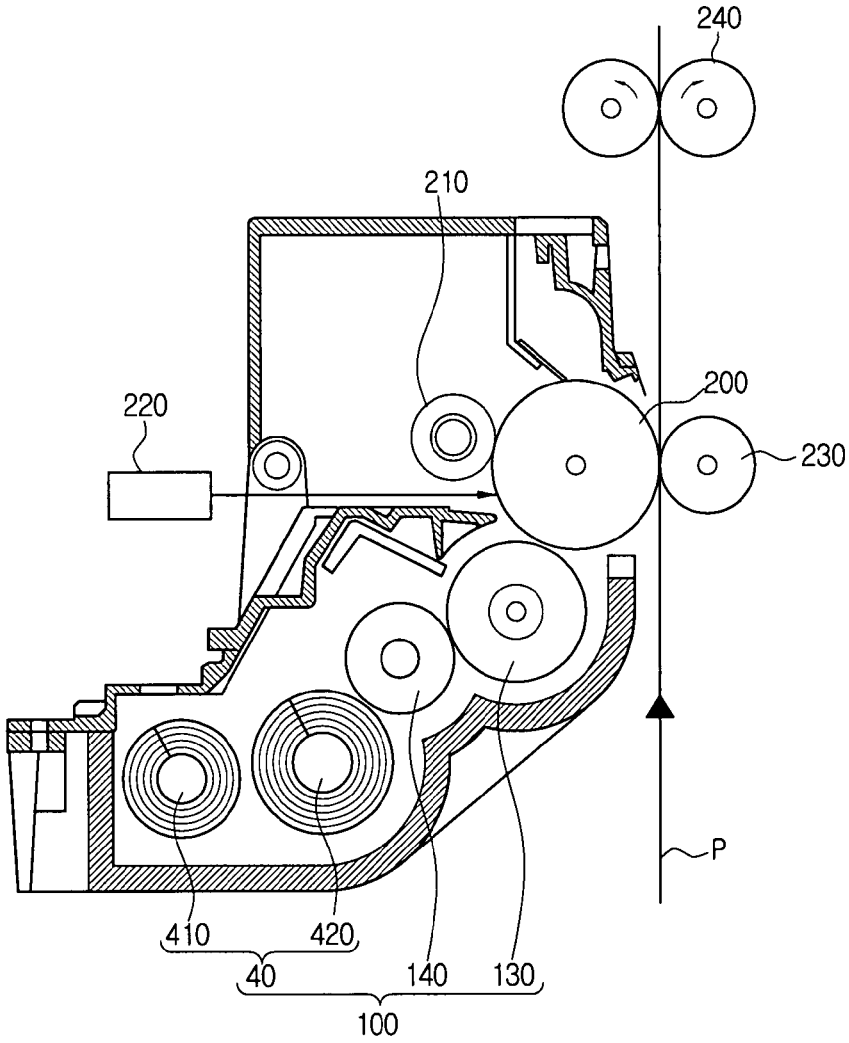
FIG. 6 is a cross-sectional view showing an example image forming device to which the developing apparatus of FIG. 4 is applied.

FIG. 6 is a cross sectional view showing a section of an example image forming device to which the developing apparatus 100 of FIG. 4 as described above is applied. Referring to the drawing, a photoconductor 200 is disposed to face the developing roller 130 of the developing apparatus 100. A charging roller 210 is rotatably disposed in contact with the photoconductor 200 to charge the photoconductor 200. A scanning unit 220, using a light source such as a laser or light emitting diode (LED), scans a beam onto a surface of the photoconductor 200 electrified by the charging roller 210, and thus forms a predetermined electrostatic latent image on the surface of the photoconductor 200.

The electrostatic latent image of the photoconductor 200 is developed into a developer image by the developing apparatus 100, and the developer image is transferred onto a printing medium P, such as paper, transparency, etc., which is conveyed between a transferring roller 230 and the photoconductor 200. The developer image transferred onto the printing medium P is fixed on the printing medium P when it passes through a fusing apparatus 240.

The image forming process as described above is the same as that of the conventional image forming device, except that by using the agitator 40 contained in the developer 100, the electrification rate of the developer is increased by the developer agitator 40 as described above, thereby allowing the image forming device to be adapted to use in high speed printing.

As is apparent from the forgoing description, according to the embodiments of the present invention, the developer agitator, and the developing apparatus and the image forming device having the same can not only smoothly agitate the developer, but also increase the electrification rate of the developer. Accordingly, the developer agitator 40, and the developing apparatus 100 and the image forming device having the same according to the embodiments of the present invention can obtain an electrification rate of the developer required for high speed printing, thereby allowing the image forming device to be operated at a high speed.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An agitator comprising:
- a rotatable shaft;
- an agitating wing disposed on a circumferential surface of the shaft; and
- an uneven part formed on an entire surface of the agitating wing to increase a contact area with a substance to be agitated,
- wherein the agitating wing is disposed in the form of a helix along the shaft.

2. The agitator of claim 1, wherein the uneven part comprises:
- a waved structure;
- a stepped structure; or
- a combination of both waved and stepped structures.

3. The agitator of claim 2, wherein the waved and/or stepped structures vary along the length of the shaft.

4. The agitator of claim 2, wherein the substance to be agitated comprises a developer.

5. The agitator of claim 1, wherein the uneven part comprises:
- a waved structure;
- a stepped structure; or
- a combination of both waved and stepped structures,
- wherein the waved structure has multiple waves and the stepped structure has multiple steps.

6. The agitator of claim 2, wherein the uneven part is oriented in the longitudinal direction of the agitating wing.

7. The agitator of claim 2, wherein the uneven part is oriented in the transverse direction of the agitating wing.

8. A developing apparatus comprising:
- a developer;
- a developing casing having a developer-containing space to hold the developer;
- a developing roller to rotate in the developing casing;
- a developer supplying roller to rotate in the developing casing to face the developing roller, so that the developer of the developer-containing space is supplied to the developing roller; and
- an agitator to electrify a developer contained in the developer-containing space by friction, wherein the agitator comprises:
  - a rotatable shaft,
  - an agitating wing disposed on a circumferential surface of the shaft, and
  - an uneven part formed on an entire surface of the agitating wing to increase the contact area with the developer,
  - wherein the agitating wing is disposed in the form of a helix along the shaft.

9. A developing apparatus comprising:
- a developer;
- a developing casing having a developer-containing space to hold the developer;
- a developing roller to rotate in the developing casing;
- a developer supplying roller to rotate in the developing casing to face the developing roller, so that the developer of the developer-containing space is supplied to the developing roller; and
- an agitator to electrify a developer contained in the developer-containing space by friction, wherein the agitator comprises:
  - a rotatable shaft,
  - an agitating wing disposed on a circumferential surface of the shaft, and
  - an uneven part formed on a surface of the agitating wing to increase the contact area with the developer,
  - wherein the agitating wing is disposed in the form of a helix along the shaft, and
  - wherein the uneven part comprises:
    - a waved structure;
    - a stepped structure; or
    - a combination of both waved and stepped structures.

10. The developing apparatus of claim 9, wherein the waved and/or the stepped structures vary along the length of the shaft.

11. The developing apparatus of claim 9, wherein the waved structure has multiple waves and the stepped structure has multiple steps.

12. The developing apparatus of claim 9, wherein the uneven part is oriented in the longitudinal direction of the agitating wing.

13. The developing apparatus of claim 9, wherein the uneven part is oriented in the transverse direction of the agitating wing.

14. An image forming device comprising:
- a photoconductor on which an electrostatic latent image is formed;
- a transferring apparatus to transfer the developer image formed on the photoconductor onto a printing medium;

a fusing apparatus to fix the developer image transferred onto a printing medium; and a developing apparatus to develop the electrostatic latent image of the photoconductor with a developer, wherein the developing apparatus comprises:

a developing casing having a developer-containing space, a developing roller to rotate in the developing casing to face the photoconductor, so that the developer in the developer-containing space moves and attaches to the photoconductor, a developer supplying roller to rotate in the developing casing to face the developing roller, so that the developer in the developer-containing space is supplied to the developing roller, and an agitator to electrify a developer contained in the developer-containing space by friction, wherein the agitator comprises:

a rotatable shaft;

an agitating wing disposed on a circumferential surface of the shaft; and an uneven part formed on an entire surface of the agitating wing to increase a contact area to the developer, wherein the agitating wing is disposed in the form of a helix along the shaft.

15. An image forming device comprising:

a photoconductor on which an electrostatic latent image is formed;

a transferring apparatus to transfer the developer image formed on the photoconductor onto a printing medium;

a fusing apparatus to fix the developer image transferred onto a printing medium; and a developing apparatus to develop the electrostatic latent image of the photoconductor with a developer, wherein the developing apparatus comprises:

a developing casing having a developer-containing space, a developing roller to rotate in the developing casing to face the photoconductor, so that the developer in the developer-containing space moves and attaches to the photoconductor, a developer supplying roller to rotate in the developing casing to face the developing roller, so that the developer in the developer-containing space is supplied to the developing roller, and an agitator to electrify a developer contained in the developer-containing space by friction, wherein the agitator comprises:

a rotatable shaft;

an agitating wing disposed on a circumferential surface of the shaft; and an uneven part formed on a surface of the agitating wing to increase a contact area to the developer, wherein the agitating wing is disposed in the form of a helix along the shaft, and wherein the uneven part is:

a waved structure;

a stepped structure; or a combination of both waved and stepped structures.

16. The image forming apparatus of claim 15, wherein the waved and/or the stepped structures vary along the length of the shaft.

17. The image forming apparatus of claim 15, wherein the waved structure has multiple waves and the stepped structure has multiple steps.

18. The image forming apparatus of claim 15, wherein the uneven part is oriented in the longitudinal direction of the agitating wing.

19. The image forming apparatus of claim 15, wherein the uneven part is oriented in the transverse direction of the agitating wing.

* * * * *